United States Patent [19]

Ikenoue

[11] Patent Number: 4,461,564

[45] Date of Patent: Jul. 24, 1984

[54] ELECTROPHOTOGRAPHIC COPYING APPARATUS WITH VARIABLE MAGNIFICATION

[75] Inventor: Yoshikazu Ikenoue, Toyokawa, Japan

[73] Assignee: Minolta Camera Kabushiki Kaisha, Osaka, Japan

[21] Appl. No.: 424,495

[22] Filed: Sep. 27, 1982

[30] Foreign Application Priority Data

Oct. 14, 1981 [JP] Japan ..... 56-164485

[51] Int. Cl.[3] ..... G03G 15/00

[52] U.S. Cl. ..... 355/8; 355/14 C; 355/14 SH

[58] Field of Search ..... 355/8, 14 SH, 14 C, 355/14 R, 55

[56] References Cited

U.S. PATENT DOCUMENTS 4,126,389 11/1978 Ikeda et al. ..... 355/13
4,129,377 12/1978 Miyamoto et al. ..... 355/14
4,217,052 8/1980 Tani et al. ..... 355/8

FOREIGN PATENT DOCUMENTS 52-75332 6/1977 Japan .

*Primary Examiner*—J. V. Truhe
*Assistant Examiner*—J. Pendegrass
*Attorney, Agent, or Firm*—Jackson, Jones & Price

[57] ABSTRACT

The disclosure is directed to an electrophotographic copying apparatus with variable magnification which is arranged to accurately register or align a leading edge of an electrostatic latent image with a leading edge of a copy paper sheet even when various copying magnifications are required, while synchronizing adjustments for the purpose are facilitated for an efficient copying operation.

22 Claims, 12 Drawing Figures

ELECTROPHOTOGRAPHIC COPYING APPARATUS WITH VARIABLE MAGNIFICATION

BACKGROUND OF THE INVENTION

The present invention generally relates to electrophotography and more particularly, to a transfer type electrophotographic copying apparatus with variable magnification, which is so arranged that, with scanning speed of an optical scanning system being altered according to copying magnifications, copy paper sheets are transported at a predetermined speed for copying at varied magnifications.

Generally, in a transfer type electrophotographic copying apparatus with variable magnification, there has been employed a system in which circumferential speed of a photosensitive member or photoreceptor and speed for transportation of copy paper sheets are maintained to be constant, while scanning speed of a scanning system for an original document is altered according to the copying magnifications as disclosed, for example, in U.S. Pat. No. 4,126,389. In the conventional system as described above, it is so arranged that copy paper sheets are transported from a predetermined stand-by position to an image transfer station so that a leading edge of an electrostatic latent image formed on the photoreceptor is registered or coincides with a leading edge of the transported copy paper sheet at the image transfer station, with a timing for starting transportation of the copy paper sheet being provided through signal from the original document scanning system.

In the known arrangement as described above, however, since the scanning speed is also altered upon variation of the copying magnification, time required from starting of the scanning up to emission of the copy paper transporation starting signal become undesirably different for each different copying magnification, thus resulting in a deviation in the synchronization between the leading edge of the electrostatic latent image and that of the copy paper sheet.

In order to eliminate the deviation in the synchronization as described above, there has also been conventionally proposed, for example, in U.S. Pat. Nos. 4,126,389 and 4,217,052, a system in which a plurality of detecting means corresponding to the copying magnifications are provided in the scanning system, and upon selection of a certain magnification, signal from the detecting means corresponding to the selected magnification is utilized as the copy paper sheet transportation starting signal. In the prior art system as described above, since the timing for starting of the copy paper sheet transportation may be readily varied through alteration of the installed position of the detecting means, adjustments can be simply made even when there are deviations in the response time and physical positionings of respective parts according to individual copying apparatuses, but in the case where a variety of copying magnifications are required, the number of detecting means is undesirably increased, with consequent high cost and complication of constructions.

In another conventional system disclosed, for example, in U.S. Pat. No. 4,129,377, attention is directed to the fact that, although scanning speed of the scanning system is varied according to alterations of the copying magnifications, circumferential speed of the photoreceptor is constant at all times, and thus, the time required from starting of light image projection of the leading edge of an original document onto the photoreceptor up to arrival of the leading edge of its electrostatic latent image at the image transfer station, is also constant at all times. More specifically, if the arrangement is so made that, by providing a detecting means for detecting that the scanning system has reached the original document leading edge exposure starting position common to any of the copying magnifications, the copy paper sheet is started to be transported from the stand-by position towards the image transfer station after a predetermined period of time not dependent on the copying magnifications, from emission of the signal by said detecting means, the leading edge of the electrostatic latent image on the photoreceptor is registered with the leading edge of the copy paper sheet at all times for any copying magnification. In the known system as described above, only one detecting means is required for the scanning system, and therefore, constructions may be simplified as compared with the system previously described, with a consequent reduction of cost, while on the other hand, there is such a disadvantage that, even if the detecting means is correctly aligned with the original document leading edge exposure starting position, in the case where deviations exist in the response time and physical positionings of respective parts, the time from emission of the detecting signal to starting of transportation of the copy paper sheet must be subjected to fine adjustments. Generally, the time as described above is composed as a program (i.e. ROM or read only memory) of a microcomputer or other digital circuits. In such a case, it is extremely difficult to adjust said time with respect to individual copying apparatuses. In other words, even a timer composed of an electrical circuit is difficult to be adjusted, and moreover, in the case where the timer value is set as a program of a microcomputer, the microcomputer itself must be replaced.

SUMMARY OF THE INVENTION

Accordingly, an essential object of the present invention is to provide a transfer type electrophotographic copying apparatus with variable magnification, which is capable of correctly registering a leading edge of an electrostatic latent image with a leading edge of a copy paper sheet even when a variety of copying magnifications are required, with simultaneous facilitation of synchronizing adjustments therefor.

Another important object of the present invention is to provide a transfer type electrophotographic copying apparatus of the above described type which is simple in construction and stable in functioning at high reliability, and can be readily manufactured at low cost.

In accomplishing these and other objects, according to one preferred embodiment of the present invention, there is provided an electrophotographic copying apparatus with variable magnification which includes a photosensitive member driven at a predetermined speed so as to sequentially pass an exposure station, a developing station and an image transfer station, a scanning means for scanning an original document at a speed corresponding to a copying magnification, a projecting means for projecting light image of the original document scanned by said scanning means onto the exposure station of the photosensitive member so as to form an electrostatic latent image corresponding to the original document on said photosensitive member, a developing means for developing said electrostatic latent image into a toner image, means for transporting a copy material or copy paper sheet towards the image transfer station from a predetermined stand-by position, and means for transferring the toner image on the photosensitive member onto the copy paper sheet fed by said transporting means at the image transfer station. The copying apparatus is particularly characterized in that there are further provided a first detecting means for detecting that said scanning means has reached an exposure starting position for substantially starting exposure and scanning of the original document, a second detecting means for detecting that the scanning means has reached a particular position spaced a predetermined distance from the exposure starting position, with the predetermined distance being equal to a difference between a circumferential length of he photosensitive member from the exposure station to the image transfer station and a length of a transportation path from the stand-by position to the image transfer station, a reference pulse generating means, a counter which starts counting upon detection of the scanning means by the first detecting means, a memory means for memorizing the count value of the counter upon detection of the scanning means by the second detecting means at least at a particular 1× magnification mode, and a control means for actuating the transporting means upon coincidence of the count value of the counter with the memorized value of the memory means during the scanning by the scanning means in a copying mode at magnification other than the 1× magnification, whereby a leading edge of the copy paper sheet being transported is registered with a leading edge of said toner image on the photosensitive member at the image transfer station irrespective of copying magnifications.

Moreover, in the arrangement according to the present invention, values set in a timer means are adapted to be automatically renewed with respect to changes with time, voltage variations, etc. so as to achieve accurate registration between the leading edges of the copy paper sheet and that of electrostatic latent image at all times, although in the conventional arrangement, the timer values are generally fixed.

Furthermore, in the arrangement of the present invention, since only two microswitches are required irrespective of the number of magnifications involved, adjustments of the microswitches are readily effected, although in the conventional arrangement, for example, in U.S. Pat. No. 4,129,377, positional adjustment of a switch for detecting the time when the scanning system scans the leading edge of the original document, has been extremely difficult, since the exposure starting position is visually adjusted independently by taking the timer value into consideration.

By the arrangement of the present invention as described above, an improved electrophotographic copying apparatus with variable magnification has been advantageously presented, with substantial elimination of disadvantages inherent in the conventional electrophotographic copying apparatus of this kind.

BRIEF DESCRIPTION OF THE DRAWINGS

These and other objects and features of the present invention will become apparent from the following description taken in conjunction with the preferred embodiment thereof with reference to the accompanying drawings, in which.

DETAILED DESCRIPTION OF THE INVENTION

Figure 1:
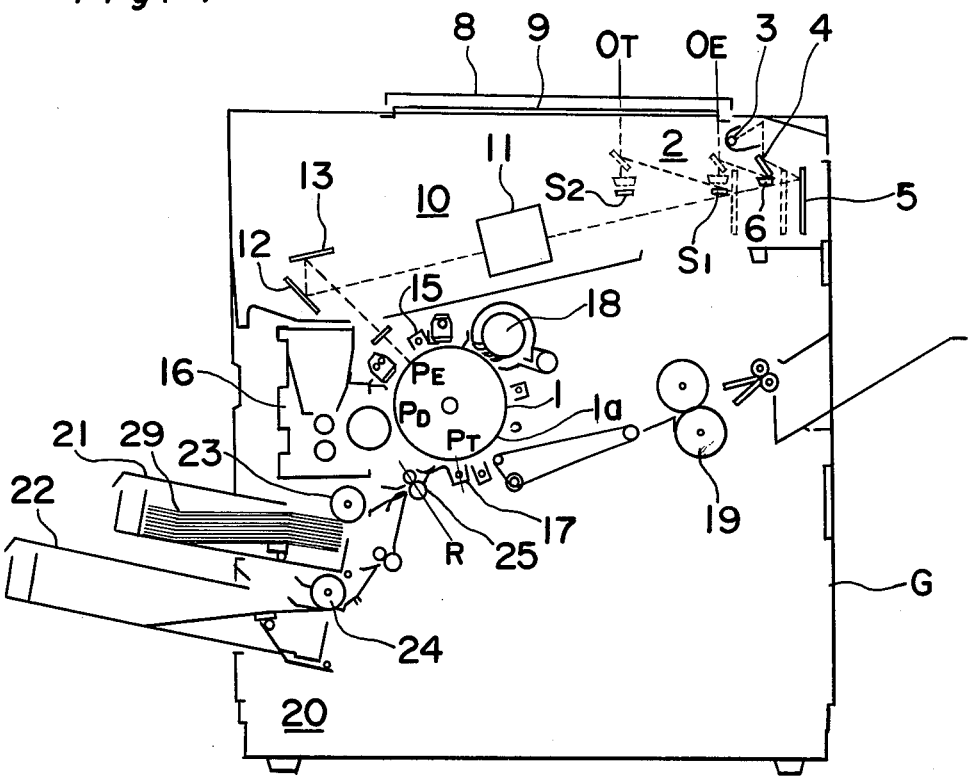
FIG. 1 is a schematic side sectional view of an electrophotographic copying apparatus to which the present invention may be applied.

Before the description of the present invention proceeds, it is to be noted that like parts are designated by like reference numerals throughout the accompanying drawings.

Referring now to the drawings, there is shown in FIG. 1 a transfer type electrophotographic copying apparatus with variable magnification according to one preferred embodiment of the present invention, which is provided with three kinds of magnifications, i.e. an equal size magnification or 1× magnification (copying at a magnification ratio of 1:1 in which a duplicate to be produced is equal in size to its original document; referred to as 1× magnification hereinbelow), a reduced size magnification and an enlarged size magnification.

It should be noted here that in the present specification, the term "copying at 1× magnification" means the copying in which copied sheets are actually produced at the 1× magnification, while the term "test copying" refers to copying without producing actual copies.

The copying apparatus of FIG. 1 generally includes a photosensitive or photoreceptor drum 1 having a photosensitive surface 1*a* formed on its peripheral surface, and rotatably provided at approximately a central portion of an apparatus housing G, an original document scanning system 2 and an image forming system 10 provided above the photoreceptor drum 1, various processing devices such as a corona charger 15, a developing device 16, a transfer charger 17, a residual toner cleaning device 18, etc. sequentially disposed around the photoreceptor drum 1 in a known manner, and also, a fixing device 19 as shown.

The original document scanning system 2 further includes an illuminating light source 3 and movable mirrors 4 and 5 arranged to be movable for scanning towards the left side in FIG. 1 in positions immediately below and adjacent to an original document platform 8 provided at the upper portion of the apparatus housing G. The light source 3 and the movable mirror 4 are adapted to move at the same speed as a circumferential speed v of the photoreceptor drum 1 in the case of copying at the 1× magnification, and at a speed of v/n in the case of copying at magnification of n times, while the movable mirror 5 moves at a speed of v/2n. Moreover, a cam 6 is secured to a support frame (not shown)

of the light source 3 and movable mirror 4, and along a moving path of said cam 6, two microswitches S1 and S2 are sequentially disposed. Meanwhile, the image forming system 10 includes a lens 11, and fixed mirrors 12 and 13.

At the left lower portion of the apparatus housing G, there is provided a paper feeding section 20 which includes paper feeding cassettes 21 and 22 arranged in two stages, paper feeding rollers 23 and 24 respectively provided for the cassettes 21 and 22, and a set of timing rollers 25 disposed adjacent to the transfer charger 17. Copy paper sheets 29 accommodated in stacks on the cassettes 21 and 22 (only the copy paper sheets on the cassette 21 are shown) are fed, one sheet by one sheet, from the top sheet of the stacks either by the paper feeding roller 23 or 24, and the leading edge of the copy paper sheet thus fed is once stopped for standing-by at a stand-by position R where said leading edge contacts the timing rollers 25, and, simultaneously with the starting of rotation of said timing rollers 25, is fed from the stand-by position R to an image transfer station $P_T$ at the transfer charger 17. In the above case, the speed for transportation of the copy paper sheet 29 by the timing rollers 25 is the same as the circumferential speed v of the photoreceptor drum 1.

An original document 9 to be copied is placed on the original document platform 8 in such a manner that one end of the original document 9 is registered with an exposure starting position $O_E$ which is equivalent to one end of said original document platform 8, and is scanned from said exposure starting position $O_E$ at all times, based on the leftward movement of the scanning system 2, and thus, an image of said original document 9 is started to be formed, through the image forming system 10, on the photosensitive surface 1*a* of the drum 1 in the form of an electrostatic latent image, from an exposure station $P_E$ on said surface 1*a* of the photoreceptor drum 1 rotating in the counterclockwise direction at the circumferential speed v. The electrostatic latent image thus formed is developed by the developing device 16 at a developing station $P_D$, and thereafter, reaches the image transfer station $P_T$ from the exposure station $P_E$ in a predetermined period of time. The exposure starting position $O_E$, time required for the leading edge of the electrostatic latent image to reach from the exposure station $P_E$ to the image transfer station $P_T$, and the stand-by position R of the copy paper sheet 29 are constant irrespective of the copying magnifications. On the other hand, the timing rollers 25 which keep the copy paper sheet 29 standing-by at the stand-by position R are driven for rotation at a proper timing so that the leading edge of the copy paper sheet 29 coincides with the leading edge of the electrostatic latent image formed on the photosensitive surface 1*a* of the photoreceptor drum 1 at the image transfer station $P_T$. In the copying at equal size or 1× magnification, the timing for starting rotation of the timing rollers 25 is at the time point when the scanning system 2 passes through a standard position $O_T$ for paper transferring i.e. the position of the microswitch S2. In other words, the distance from the exposure starting position $O_E$ to the standard position $O_T$ for paper transferring is equal to a value obtained by substracting a distance between the stand-by position R and the image transfer station $P_T$, from a distance between the exposure station $P_E$ and the image transfer station $P_T$.

Figure 2:
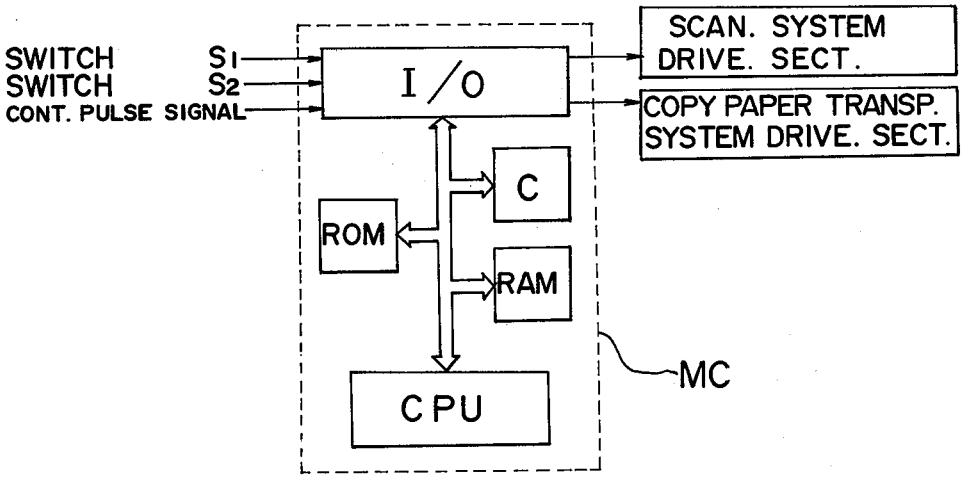
FIG. 2 is a block diagram explanatory of a control means employed in the copying apparatus of FIG. 1, FIGS. 3 to 5 are time-charts explanatory of functions of a scanning system employed in the copying apparatus of FIG. 1.

Therefore, the microswitch S1 is disposed at the exposure starting position $O_E$, and the microswitch S2 is disposed at the standard position $O_T$ for paper transferring so as to be turned on by the cam 6 when the scanning system 2 passes through the respective positions $O_E$ and $O_T$. The signals from the microswitches S1 and S2 thus turned on are arranged to be applied to a microcomputer MC as shown in FIG. 2, which generally includes an input/output port I/O coupled to a central processing unit CPU, a random access memory RAM, a read only memory ROM and a counter C in a known manner. To the input/output port I/O, the turned on signals from the microswitches S1 and S2, and also, control pulse signal or reference signal are applied, while signals for a scanning system driving section and a copy paper transport system driving section to be described later are produced from said input/output port I/O. The control pulse signal or reference signal applied to the input/output port I/O as described above is a reference signal for the control function of the microcomputer MC, and may be of a control pulse signal such as a clock pulse signal, etc. or of a motor driving pulse and the like.

Figure 3:
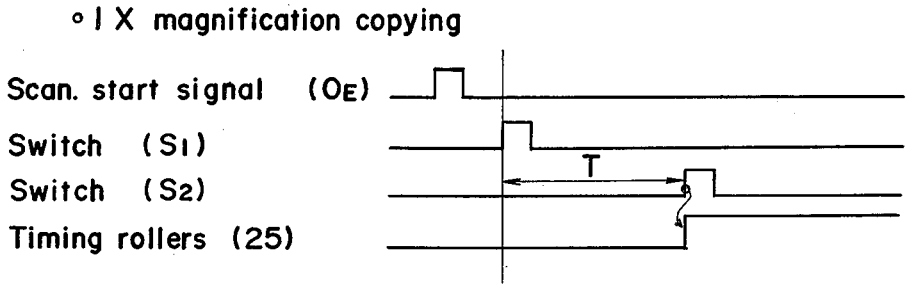

On the other hand, in the variable magnification transfer type copying apparatus according to the present invention as described so far, the scanning system 2 is arranged to start moving from a scanning starting position (shown by solid lines in FIG. 1) prior to the position of the leading edge of the original document 9, i.e. the exposure starting position $O_E$. During copying at the 1× magnification, upon arrival of the scanning system 2 at the exposure starting position $O_E$, light image of the original document 9 is projected onto the exposure station $P_E$ on the photosensitive surface 1*a* of the photoreceptor drum 1, while simultaneously, the microswitch S1 is turned on by the cam 6 of the scanning system 2. Upon receipt of the signal from the microswitch S1 in the manner as described earlier, the microcomputer MC starts counting of the control reference pulses by the counter C thereof. When the scanning system 2 further effects scanning and reaches the standard position $O_T$ for paper transferring, the cam 6 of the scanning system 2 turns on the microswitch S2. Upon turning on of the microswitch S2, the microcomputer MC stops the counting by the counter C so as to memorize the counted value thereof in the memory means. Simultaneously, the timing rollers 25 start rotating to initiate transportation of the copy paper sheet 29 which has already been fed selectively from the cassette 21 or 22, and is standing by at the stand-by position R. In the above case, the leading edge of the electrostatic latent image formed on the photosensitive surface 1*a* of the photoreceptor drum 1 is located in a position equal in distance to the distance from the stand-by position R up to the image transfer station $P_T$, as measured in a direction opposite to the rotating direction from said image transfer station $P_T$. Since the speed of transportation of the copy paper sheet 29 is equal to the circumferential speed of the photoreceptor drum 1, the leading edge of the electrostatic latent image is to be registered with the leading edge of the copy paper sheet 29 at the image transfer station $P_T$ (See time-chart of FIG. 3).

In the copying at magnifications other than the 1× magnification, the scanning system 2 starts moving from the solid line position in FIG. 1 in the similar manner as in the 1× magnification, and arrives at the exposure starting position $O_E$ in a state where speed v/n corresponding to a selected magnification n has been reached so as to turn on the microswitch S1. Upon receipt of the signal produced by the microswitch S1, the microcomputer MC starts counting of the reference pulses in the similar manner as in the case of the 1× magnification as described earlier, while the copy paper sheet 29 is also standing-by at the stand-by position R in the similar manner as in the 1× magnification. The scanning system 2 continues scanning as it is, but, different from the case for the copying at the 1× magnification, the microcomputer MC effects comparison with respect to the count value which has been memorized in the memory means during the copying at the 1× magnification, while performing counting by the counter C. When the count value of the counter C becomes equal to the count value at the 1× magnification mode which has been memorized in the memory means, the microcomputer MC causes the timing rollers 25 to rotate so as to transport the copy paper sheet 29 from the stand-by position R towards the image transfer station $P_T$. In the above case, since the circumferential speed of the photoreceptor drum 1 is not altered by the magnifications, the leading edge of the electrostatic latent image on the photosensitive surface 1*a* of the photoreceptor drum 1 is located at the position equal in distance to the distance from the stand-by position R to the image transfer station $P_T$, as measured in the direction opposite to the rotating direction from the image transfer station $P_T$ in the similar manner as in the copying at the 1× magnification. Therefore, in the copying at a varied magnification also, the leading edge of the electrostatic latent image is to be registered with the leading edge of the copy paper sheet.

Figure 4:
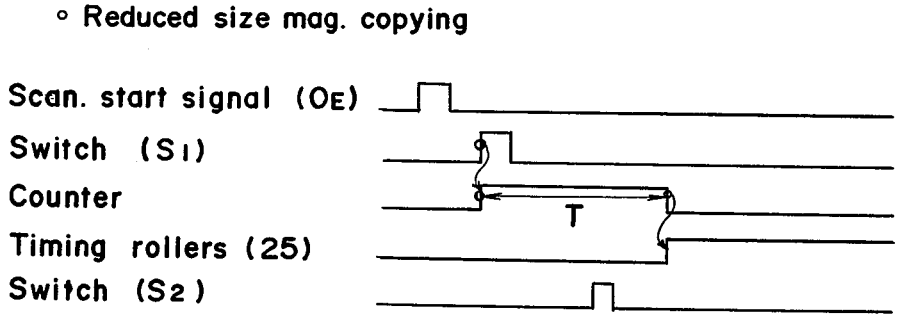
Figure 5:
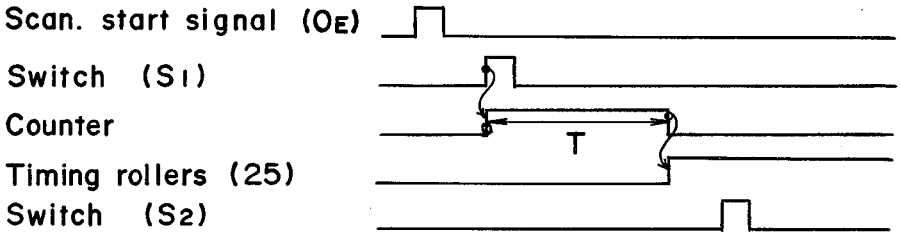

Time charts for copying at the varied magnifications i.e. for copying at the magnifications other than the 1× magnification or uneven size magnifications are shown in FIGS. 4 and 5.

In the time chart for copying at a reduced size magnification shown in FIG. 4, since the scanning speed V/n is higher than the circumferential speed v of the photoreceptor drum 1, the timing rollers 25 are started after turning on of the microswitch 52, while, in an enlarged size magnification as shown in the time chart of FIG. 5, since the scanning speed v/n is lower than the circumferential speed v of the photoreceptor drum 1, the timing rollers 25 are started before turning on of the microswitch S2.

As is seen from the foregoing description, according to the arrangement of the present invention, with employment of the two detecting means, i.e. the microswitches S1 and S2, by merely counting the number of reference pulses from the turning on of the microswitch S1 to the turning on of the microswitch S2 during the copying at the 1× magnification, it is possible to register the electrostatic latent image formed on the photosensitive surface 1*a* of the photoreceptor drum 1, with the copy paper sheet at the image transfer station $P_T$ even when any copying magnification is selected.

However, since the random access memory RAM of the microcomputer MC commonly employed as the memory means is of a so-called volatile memory which is cleared of the contents memorized therein upon turning off of a power supply, it is necessary to cause the memory means to memorize a proper value after turning on of the power supply. As countermeasures for the above, methods as follows may be adopted.

Figure 6:
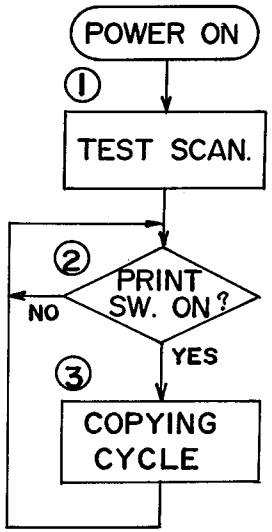
FIG. 6 is a flow-chart for effecting counting by a counter in a particular 1× magnification mode.

In a first method, as shown in a flow-chart of FIG. 6, it is so arranged that, before copying is actually performed after turning on of the power supply, only the scanning system 2 is moved at the same speed as in the copying at the 1× magnification without transportation of the copy paper sheet at a step ①, and the counting is effected from the turning on of the microswitch S1 up to the turning on of the microswitch S2 so as to carry out a series of test scanning for memorizing the count value, and thereafter, said count value is employed for the copying at varied magnifications (i.e. copying at magnifications other than the 1× magnification) until the copying at 1× magnification is selected. Then, at a step ②, judgement is made as to whether or not the print switch is turned on, and if the judgement is of "YES", copying is effected at a step ③.

Figure 7:
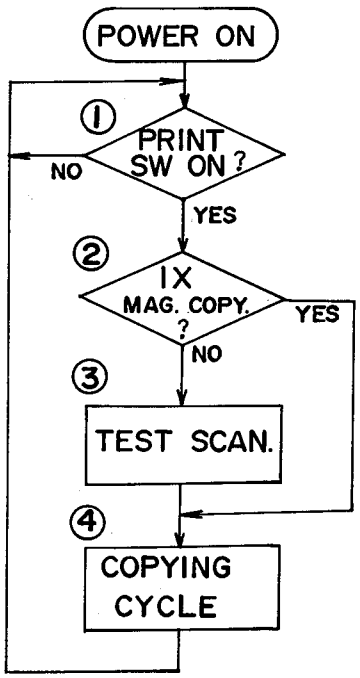

In a second method, as shown in a flow-chart of FIG. 7, after turning on of the power supply, judgement is made as to whether or not the print switch is turned on at a step ①, and if the judgement is of "YES", judgement is further made at a step ② as to whether or not the copying at 1× magnification is first selected. If the judgement is of "NO", i.e. if the copying at a varied magnification (i.e. copying at a magnification other than the 1× magnification) is initially selected, test scanning similar to that in the first method as described above is effected at a step ③, and after completion of the above test scanning, the copying at the varied magnification as selected is effected at a step ④. On the other hand, if the judgement is of "YES" at a step ②, i.e. if the copying at the 1× magnification is initially selected, such copying at the 1× magnification is effected at a step ④. By the above first copying at the magnification of 1:1, count value as a reference value is memorized in the memory means, and thereafter, copying at the varied magnification is effected with the use of said count value.

Figure 8:
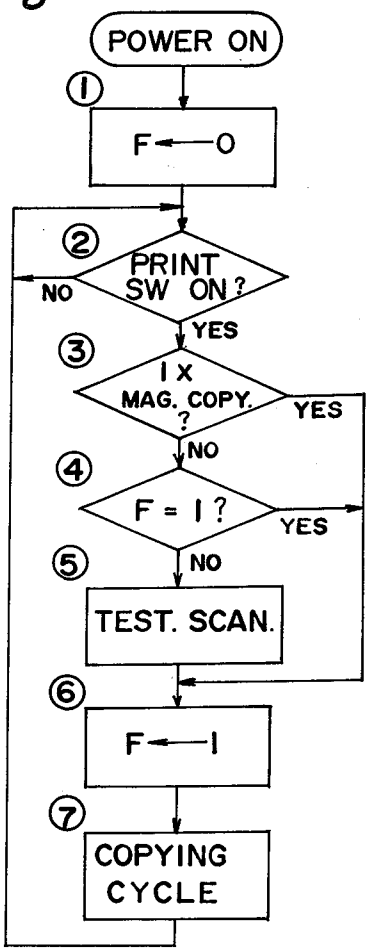
FIGS. 7 and 8 are flow-charts similar to FIG. 6, which particularly show modifications thereof.

In a third method, as shown in a flow-chart of FIG. 8, there is provided a flag F for indicating that the count value of the 1× magnification mode as a reference value has been definitely input into the memory means. More specifically, the flag F is reset at a step ①, and judgement is made at a step ② as to whether or not the print switch is turned on. If the judgement is of "YES", judgement is further made at a step ③ as to whether or not the copying at 1× magnification is first selected. If the judgement is of "NO", another judgement is made at a step ④ as to whether or not the flag F is of "1". Since the flag F has been reset at the step ①, judgement is of "NO" at the step ④ and test scanning similar to that described previously is effected at a step ⑤. Thereafter, the flag F is set to "1" at a step ⑥ and the copying at the varied magnification as selected is effected at a step ⑦. Subsequently, even if copying at the varied magnifications is continuously selected, judgement is of "YES" at the step ④, since the flag F maintains the set state, and thus, the test scanning at the step ⑤ is omitted. On the other hand, if the copying at the 1× magnification is initially selected, judgement is made as "YES" at the step ③, and the flag F is set to "1" at the step ⑥ for effecting the copying at the 1× magnification at a step ⑦. By the above first copying at the 1× magnification, the court value as the reference value is memorized in the memory means in the similar manner as in the second method.

It should be noted here that, if a copying apparatus to be employed is of such a type as will carry out a preliminary scanning before actual copying, the test scanning may be combined with such preliminary scanning.

Subsequently, the test scanning referred to earlier will be explained with reference to a flow-chart of FIG. 9.

Figure 9:
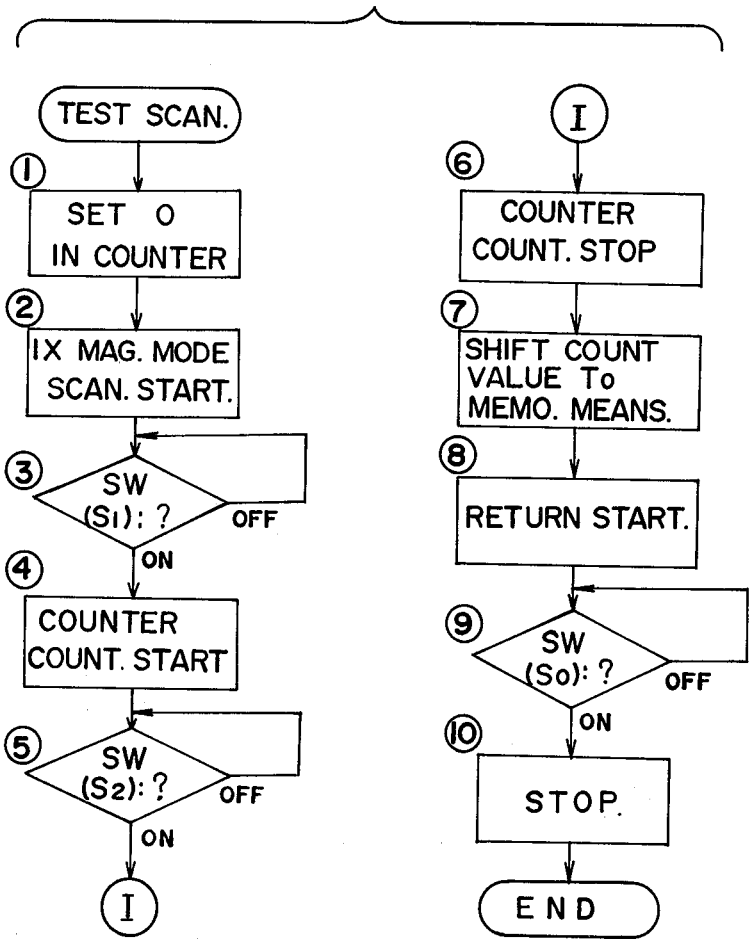
FIG. 9 is a flow-chart explanatory of a test scanning.

In FIG. 9, "0" is first set in the counter at a step ①, and the scanning at the 1× magnification mode is started at a step ②. At a step ③, judgement is made as to whether or not the microswitch S1 is turned on, and if it is in the "on" state, counting by the counter is started at a step ④ for judgement for "on" or "off" of the microswitch S2 at a step ⑤. When the microswitch S2 is turned on, counting by the counter is suspended at a step ⑥ for shifting the count value into the memory means at a step ⑦. Subsequently, the scanning system 2 is returned at a step ⑧, and judgement is made as to whether or not a switch S0 is turned on at a step ⑨. Although not particularly shown, this switch S0 is arranged to be turned on when the scanning system 2 has returned to the starting position of its movement, i.e. when the scanning system 2 has returned to the position indicated by the solid lines in FIG. 1, and if said switch S0 has been turned on, the returning of the scanning system 2 is stopped at a step ⑩.

Furthermore, description will be made hereinbelow on the copying cycle with reference to a flow-chart of FIG. 10.

Figure 10:
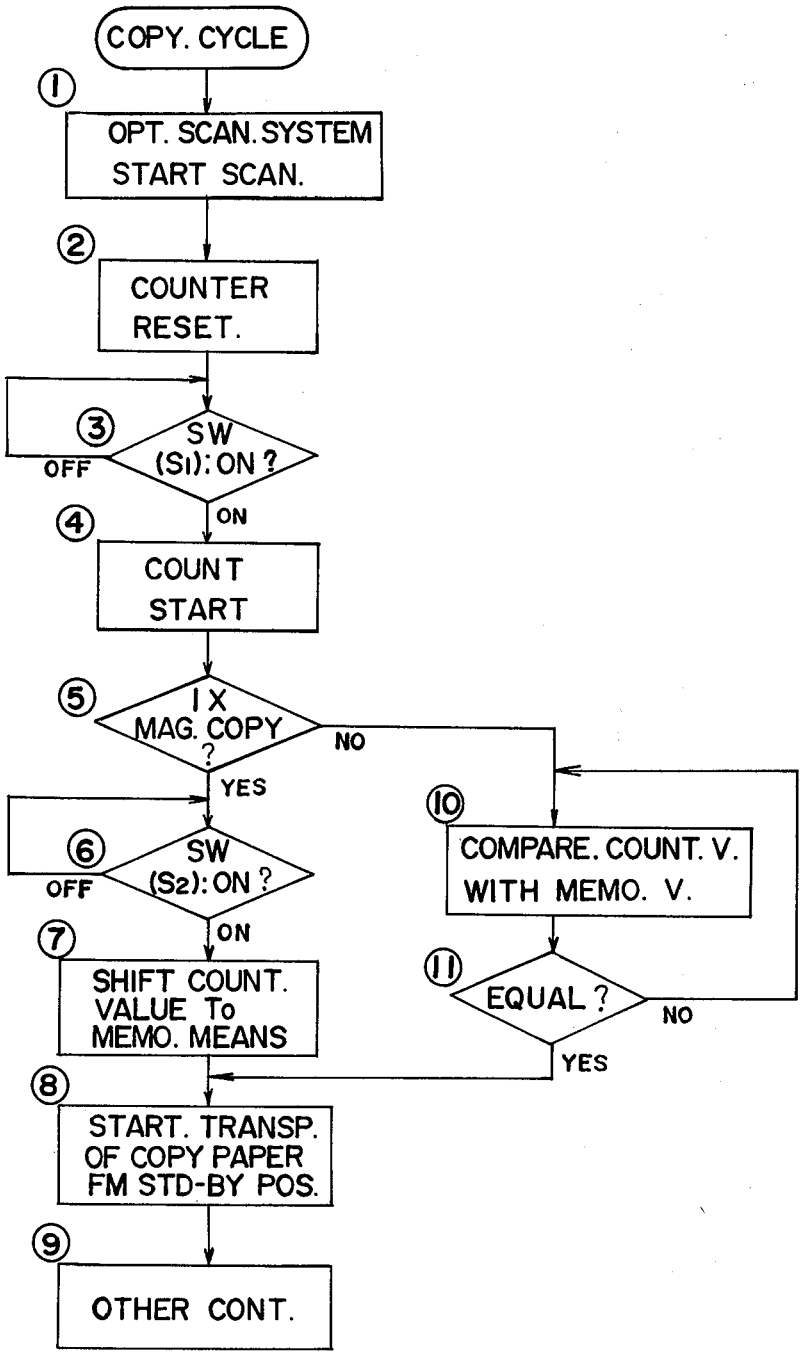
FIG. 10 is a flow-chart explanatory of a copying cycle.

In FIG. 10, scanning by the scanning system is first started at a step ① and the counter is reset at a step ②. Subsequently, judgement is made at a step ③ as to whether the microswitch S1 is on or off, and if it is turned on, counting by the counter is started at a step ④, with further judgement at a step ⑤ as to whether or not the copying at the 1× magnification is selected. If the judgement is of "YES", "on" or "off" of the microswitch S2 is judged at a step ⑥, and if it is turned on, the count value of the counter is shifted into the memory means at a step ⑦. At a step ⑧, rotation of the timing rollers 25 is started for transportation of the copy paper sheet 29 located at the stand-by position R towards the image transfer station $P_T$, while control of the developing device 16, fixing device 19, etc. is effected at a step ⑨. Meanwhile, if the judgement is of "NO" at the step ⑤ with copying at a varied magnification (i.e. copying at a magnification other than the 1× magnification) is selected, the step is shifted to a step 10 for comparison of the memorized count value of the counter at the 1× magnification mode with the count value counted at the step ④, with subsequent judgement as to whether or not the both values are equal to each other at a step ⑪. If said values are equal, the step is shifted to the step ⑧ to start transportation of the copy paper sheet 29 from the standby position R.

In the first, second and third methods as described earlier, renewal of the values memorized in the memory means is effected at each test scanning and copying at 1× magnification, and thus, since the memorized values are of the latest data at all times it is possible to achieve accurate registration between the leading edges of the copy paper sheet and electrostatic latent image at all times.

Meanwhile, from a different angle of view, the copying apparatus of the above described type is used in many cases in such a manner that the power supply thereof is normally turned on in the morning and turned off in the evening to correspond to office hours and the like, and therefore, the memorized values for the 1× magnification are normally renewed in the span of about one day or so, although renewal of the timer value is not necessary. If the renewal of the memorized value through the span to the above extent is regarded to be sufficient, it may be so arranged that the step ⑦ of FIG. 10 is omitted for effecting the renewal of the memorized values only through the test scanning.

To effect the test scanning each time the power supply is turned on is troublesome or wasteful for users of the copying apparatus. In order to eliminate such an inconvenience, memory means which is not cleared of the memorized contents even upon turning off of the power supply, for example, (1) a random access memory backed up by a battery power or (2) a non-volatile memory which retains the memorized values even when the power supply is turned off may be employed. Since the test scanning may be omitted when such a memory as described above is employed, but correction of the value at the 1× magnification should preferably be effected, the renewal of the memorized values is effected for each and all copying at the 1× magnification according to the time chart as shown in FIG. 10.

On the other hand, in the present invention, when the microswitches S1 and S2 which are the two detecting means are not correctly set respectively at the exposure starting position $O_E$ and the standard position $O_T$ for paper transferring, it is naturally impossible to achieve the registration of the leading edges as described earlier. However, adjustments for such registration may be effected in the manner as follows. In the first place, copying at the 1× magnification is effected for adjustment of the standard position $O_T$ for paper transferring of the microswitch S2 so as to achieve said registration for copying at the 1× magnification, whereby all the deviations other than those at the position of the microswitch S1 are corrected. Subsequently, copying is effected at a magnification by which the absolute value of a difference with respect to the 1× magnification becomes maximum for adjustment of the microswitch S1 so as to achieve said registration. Finally, the copying at the 1× magnification is effected for the renewal of the values within the memory means.

It is to be noted here that in the foregoing embodiment, a control pulse generating means of the microcomputer MC has been employed for producing the reference pulses to be applied to the counter. In the case as described above, there is no problem so far as the reference pulses and revolutions of the photoreceptor drum 1 are stable, but if any variation is present in either of the above, it becomes impossible to accurately register the leading edge of the electrostatic latent image with the leading edge of the copy paper sheet 29 at the image transfer station $P_T$.

More specifically, as shown in FIG. 1, when the scanning system 2 has reached the exposure starting position $O_E$ and starts scanning of the original document 9, projection of the light image of the original document onto the exposure station $P_E$ on the photosensitive surface 1*a* of the photoreceptor drum 1 is started, and the time required for the leading edge of the electrostatic latent image to reach the image transfer station $P_T$, depends on the circumferential speed of the photoreceptor drum 1. Therefore, pulse obtained by a pulse generating means synchronized with rotation of the photoreceptor drum 1, for example, pulses obtained by a photo-coupler from a pulse disc coaxially provided with the photoreceptor drum 1, may be employed. By the arrangement as described above, even when there is a variation in the circumferential speed of the photoreceptor drum 1, the counting of the counter corresponds to the above variation, and thus, the leading edge of the electrostatic latent image on the photoreceptor drum 1 is registered with the leading edge of the copy paper sheet without fail.

It should also be noted that, in the foregoing embodiment, although the present invention has been mainly described with reference to the variable magnification transfer type copying apparatus in which the light source 3, and movable mirrors 4 and 5 as the scanning system of the original document are moved with respect to the stationary original document, the concept of the present invention is not limited in its application to the copying apparatus of the optical system moving type alone but may readily be applied to copying apparatuses of other types within the scope as follows.

Figure 11:
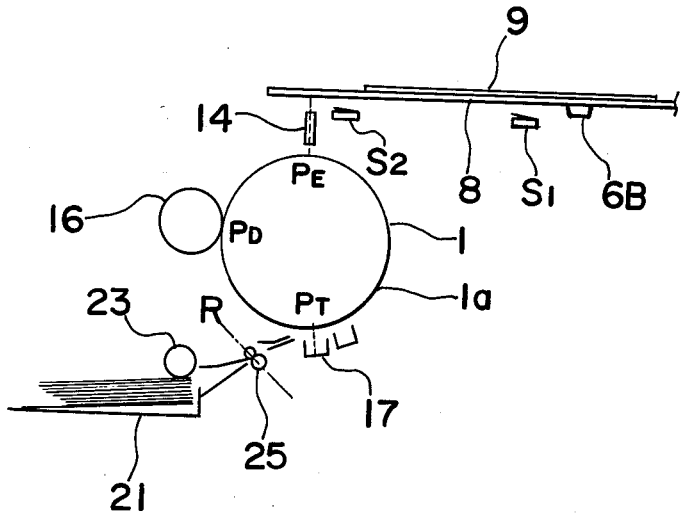
FIG. 11 is a fragmentary side sectional view showing an esssential portion of an electrophotographic copying apparatus according to a modification of the present invention.

More specifically, the copying apparatus to which the present invention is applicable, may, for example, be a copying apparatus of a type in which the original document platform 8 is arranged to be movable as an original document scanning system as shown in FIG. 11. Since the arrangement of FIG. 11 is generally similar to that of FIG. 1 except that the cam 6 is modified into a cam 6B fixed to the platform 8 and a known image transmitter formed of a plurality of graded index fibers in bundled configuration i.e. SELFOC (name used in trade and manufactured by Nippon Sheet Glass Company, Limited, Japan) array 14 is employed for the optical system, like parts in FIG. 1 are designated by like reference numerals, with detailed description thereof being abbreviated for brevity.

Figure 12:
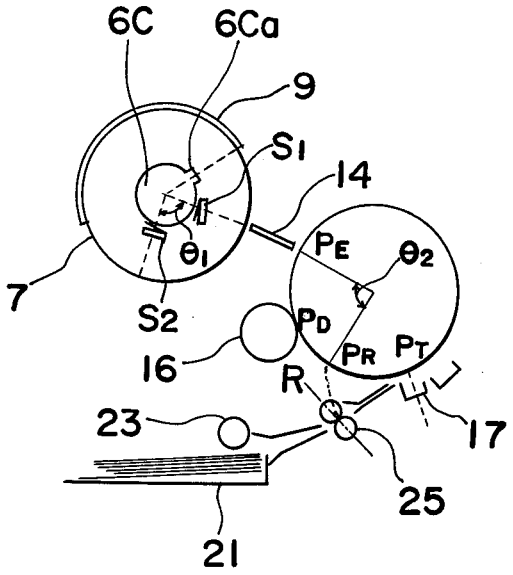
FIG. 12 is a view similar to FIG. 11, which particularly shows another modification thereof.

Furthermore, the copying apparatus to which the present invention is applied may be a copying apparatus of a type in which the original document platform 8 described as employed in the arrangement of FIG. 1 is replaced by an original document drum 7 and the original document 9 in a sheet form is applied onto the outer peripheral surface of the original document drum 7 as a scanning system for scanning through rotation of said drum 7 by the SELFOC array 14 as shown in a modification of FIG. 12. In this modification, the circumferential speed of the drum 7 is arranged to vary according to the copying magnifications. Moreover, the cam 6 in FIG. 1 is modified into a cam disc 6C coaxial with the original document drum 7, and the microswitches S1 and S2 are altered in their positions so as to be disposed along the moving path of a projection 6C*a* of the cam 6C. The set angle $\theta 1$ between the microswitches S1 and S2 is equal to a distance required for the photoreceptor drum 1 to rotate through an angle of $\theta 2$, and that required for the original document drum 7 to rotate through an angle of $\theta 1$, on the assumption that the angle $\theta 2$ is equivalent to a distance from the exposure station $P_E$ on the photoreceptor drum 1 to a position $P_R$ on the photoreceptor drum 1 corresponding to the stand-by position R.

As is clear from the foregoing description, according to the electrophotographic copying apparatus with variable magnification of the present invention, there are provided the first detecting means for detecting that the scanning means has reached the exposure starting position for substantially starting exposure and scanning of the original document, the second detecting means for detecting that the scanning means has reached a particular position spaced a predetermined distance from the exposure starting position, with the predetermined distance being equal to a difference between a circumferential length of the photosensitive member from the exposure station to the image transfer station and a length of a transportation path from the stand-by position to the image transfer station, the reference pulse generating means, the counter which starts counting upon detection of the scanning means by the first detecting means, the memory means for memorizing the count value of the counter upon detection of the scanning means by the second detecting means at least at a particular 1× magnification mode, and the control means for actuating the transporting means upon coincidence of the count value of the counter with the memorized value of the memory means during the scanning by the scanning means in a copying mode at magnification other than the 1× magnification so that the leading edge of the copy material being transported is registered with the leading edge of the toner image on the photosensitive member at the image transfer station, irrespective of copying magnifications, and therefore, it is possible to synchronize the electrostatic latent image formed on the photosensitive member with the copy paper sheet according to various copying magnifications by the functioning of the first detecting means, while the synchronizing adjsutment may be readily effected through mere positional adjustment of the first and second detecting means.

Although the present invention has been fully described by way of example with reference to the accompanying drawings, it is to be noted here that various changes and modifications will be apparent to those skilled in the art. Therefore, unless otherwise such changes and modifications depart from the scope of the present invention, they should be construed as included therein.

What is claimed is:

1. In an electrophotographic copying apparatus with variable magnification, which includes a photosensitive member driven at a predetermined speed so as to sequentially pass an exposure station, a developing station and an image transfer station, a scanning means for scanning an original document at a speed corresponding to a copying magnification, a projecting means for projecting light image of the original document scanned by said scanning means onto the exposure station of the photosensitive member so as to form an electrostatic latent image corresponding to the original document on said photosensitive member, a developing means for developing said electrostatic latent image into a toner image, means for transporting a copy material towards the image transfer station from a predetermined stand-by position, and means for transferring the toner image on the photosensitive member onto the copy material fed by said transporting means at the image transfer station, the improvement comprising a first detecting means for detecting that said scanning means has reached an exposure starting position for substantially starting exposure and scanning of the original document, a second detecting means for detecting that said scanning means has reached a particular position spaced a predetermined distance from said exposure starting position, said predetermined distance being equal to a difference between a circumferential length of said photosensitive member from said exposure station to said image transfer station and a length of a transportation path from the stand-by position to the image transfer station, a reference pulse generating means, a counter which starts counting upon detection of said scanning means by said first detecting means, a memory means for memorizing the count value of said counter, upon detection of said scanning means by said second detecting means at least at a particular 1× magnification mode, and a control means for actuating said transporting means upon coincidence of the count value of said counter with the memorized value of said memory means during the scanning by said scanning means in a copying mode at magnification other than the 1× magnification, whereby a leading edge of the copy material being transported is registered with a leading edge of said toner image on said photosensitive member at said image transfer station irrespective of copying magnifications.

2. An electrophotographic copying apparatus as claimed in claim 1, wherein said memory means is one arranged to be cleared of memorized contents thereof upon turning off of a main power supply therefor, said particular 1× magnification mode being a test scanning mode for causing the scanning means to scan at speed for the 1× magnification after turning on of the main power supply.

3. An electrophotographic copying apparatus as claimed in claim 1, wherein said memory means is one arranged to be cleared of memorized contents thereof upon turning off of a main power supply therefor, said particular 1× magnification mode being a test scanning mode for causing the scanning means to scan at speed for the 1× magnification prior to the copying mode at magnification other than the 1× magnification, upon selection of said copying mode at magnification other than the 1× magnification.

4. An electrophotographic copying apparatus as claimed in claim 3, wherein said test scanning mode is effected only with respect to a copying mode at magnification other than 1× magnification, first selected after turning on of the main power supply.

5. An electrophotographic copying apparatus as claimed in claim 1, wherein said memory means is one arranged not to be cleared of memory contents thereof even upon turning off of a power supply therefor.

6. An electrophotographic copying apparatus as claimed in claim 5, wherein said particular 1× magnification mode is for each and all the 1× magnification copying modes.

7. An electrophotographic copying apparatus as claimed in claim 1, 2, 3, 4, 5 or 6, wherein said reference pulses are control pulses which serve as a basis for the control means to effect control.

8. An electrophotographic copying apparatus as claimed in claim 1, 2, 3, 4, 5 or 6, wherein said reference pulses are pulses synchronized with driving of said photosensitive member.

9. An electrophotographic copying apparatus as claimed in claim 2, 3 or 4, wherein the memorized value of said memory means is further arranged to be renewed for each and all the 1× magnification copying modes while the power supply is turned on.

10. An electrophotographic copying apparatus as claimed in claim 5, wherein said reference pulses are control pulses which serve as a basis for the control means to effect control.

11. An electrophotographic copying apparatus as claimed in claim 9, wherein said reference pulses are pulses synchronized with driving of said photosensitive member.

12. In an electrophotographic copying apparatus with variable magnification which includes a photosensitive member driven at a predetermined speed so as to sequentially pass an exposure station, a developing station and an image transfer station, a scanning means for scanning an original document at a speed corresponding to a copying magnification, a projecting means for projecting light image of the original document scanned by said scanning means onto the exposure station of the photosensitive member so as to form an electrostatic latent image corresponding to the original document on said photosensitive member, a developing means for developing said electrostatic latent image into a toner image, means for transporting a copy material towards the image transfer station from a predetermined stand-by position, and means for transferring the toner image on the photosensitive member onto the copy material fed by said transporting means at the image transfer station, the improvement comprising a first detecting means for detecting that said scanning means has reached an exposure starting position for substantially starting exposure and scanning of the original document, a second detecting means for detecting that said scanning means has reached a particular position spaced a predetermined distance from said exposure starting position, said predetermined distance being equal to a difference between a circumferential length of said photosensitive member from said exposure station to said image transfer station and a length of a transportation path from the stand-by position to the image transfer station, a reference pulse generating means, and a microcomputer including a counter unit which starts counting upon detection of said scanning means by said first detecting means, a memory unit for memorizing the count value of said counter unit upon detection of said scanning means by said second detecting means at least at a particular 1× magnification mode, and a control unit for actuating said transporting means upon coincidence of the count value of said counter unit with the memorized value of said memory unit during the scanning by said scanning means in a copying mode at magnification other than the 1× magnification, whereby a leading edge of the copy material being transported is registered with a leading edge of said toner image on said photosensitive member at said image transfer station irrespective of copying magnifications.

13. An electrophotographic copying apparatus as claimed in claim 12, wherein said memory unit is one arranged to be cleared of memorized contents thereof upon turning off of a main power supply therefor, said particular 1× magnification mode being a test scanning mode for causing the scanning means to scan at speed for the 1× magnification after turning on of the main power supply.

14. An electrophotographic copying apparatus as claimed in claim 12, wherein said memory unit is one arranged to be cleared of memorized contents thereof upon turning off of a main power supply therefor, said particular 1× magnification mode being a test scanning mode for causing the scanning means to scan at speed for the 1× magnification prior to the copying mode at magnification other than the 1× magnification, upon selection of said copying mode at magnification other than the 1× magnification.

15. An electrophotographic copying apparatus as claimed in claim 14, wherein said test scanning mode is effected only with respect to a copying mode at magnification other than 1× magnification, first selected after turning on of the main power supply.

16. An electrophotographic copying apparatus as claimed in claim 12, wherein said memory unit is one arranged not to be cleared of memory contents thereof even upon turning off of a power supply therefor.

17. An electrophotographic copying apparatus as claimed in claim 16, wherein said particular 1× magnification mode is for each and all the 1× magnification copying modes.

18. An electrophotographic copying apparatus as claimed in claim 12, 13, 14, 15, 16 or 17, wherein said reference pulses are control pulses which serve as a basis for the control unit to effect control.

19. An electrophotographic copying apparatus as claimed in claim 12, 13, 14, 15, 16 or 17, wherein said reference pulses are pulses synchronized with driving of said photosensitive member.

20. An electrophotographic copying apparatus as claimed in claim 13, 14 or 15, wherein the memorized value of said memory unit is further arranged to be renewed for each and all the 1× magnification copying modes while the power supply is turned on.

21. An electrophotographic copying apparatus as claimed in claim 20, wherein said reference pulses are control pulses which serve as a basis for the control unit to effect control.

22. An electrophotographic copying apparatus as claimed in claim 20, wherein said reference pulses are pulses synchronized with driving of said photosensitive member.

* * * * *